United States Patent [19]

Nomura et al.

[11] Patent Number: 4,982,677

[45] Date of Patent: Jan. 8, 1991

[54] PATTERN-MATCHING SHEET-JOINING MACHINE

[75] Inventors: Etsuzo Nomura, Kasugai; Hirokasu Takeuchi; Shigeru Suzuki, both of Nagoya; Kazunori Irie, Ichinomiya; Hirosumi Itoh, Nagoya, all of Japan

[73] Assignee: Brother Kogyo Kabushiki Kaisha, Japan

[21] Appl. No.: 302,313

[22] Filed: Jan. 27, 1989

[30] Foreign Application Priority Data

Jan. 28, 1988 [JP] Japan ..... 63-17693
Jan. 28, 1988 [JP] Japan ..... 63-17695

[51] Int. Cl.[5] ..... D05B 27/06; D05B 27/08

[52] U.S. Cl. ..... 112/314; 112/121.11; 112/320; 226/32; 356/425

[58] Field of Search ..... 112/314, 313, 306, 320, 112/312, 315, 121.11, 121.26, 153, 272; 250/559, 226, 548, 561, 571; 356/425, 429

[56] References Cited

U.S. PATENT DOCUMENTS

| | | | |
|---|---|---|---|
| 3,726,399 | 4/1973 | Beamish et al. | 356/425 X |
| 4,526,116 | 7/1985 | Mannel | 112/121.12 X |
| 4,612,867 | 9/1986 | Rosch et al. | 112/314 |
| 4,652,136 | 3/1987 | Harjunmaa | 356/425 X |
| 4,766,828 | 8/1988 | Nomura et al. | 112/314 |
| 4,777,896 | 10/1988 | Nomura | 112/121.11 X |
| 4,788,650 | 11/1988 | Willis et al. | 356/429 |
| 4,901,659 | 2/1990 | Nomura et al. | 112/314 |

*Primary Examiner*—Peter Nerbun
*Attorney, Agent, or Firm*—Oliff & Berridge

[57] ABSTRACT

A pattern-matching joining machine for joining two sheets (e.g., sewing two cloths) having the same patterns with the patterns matching. The pattern-sensing photo-sensor generates intensity data for three different colors and the color data processed to correctly discriminate elements of a pattern having colors of similar brightnesses, and to accurately pick out pattern elements with faint colors from behind outstanding pattern elements. One way of processing the data includes calculating differences between intensity data for different colors. Another way includes selecting the color that has the largest intensity change.

41 Claims, 17 Drawing Sheets

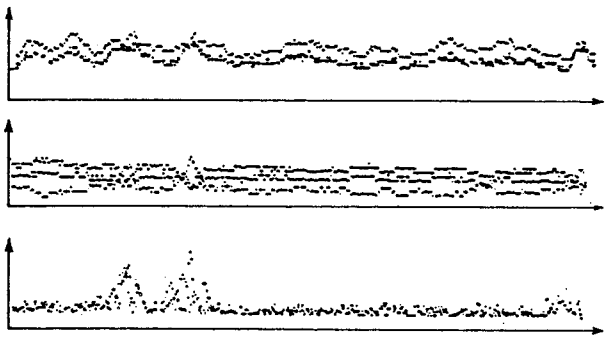
FIG. 12B
RAW R, G & B SIGNALS
FIG. 12C
DIFFERENCES
FIG. 12D
TOTAL
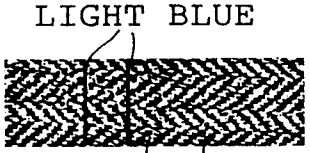
FIG. 12A
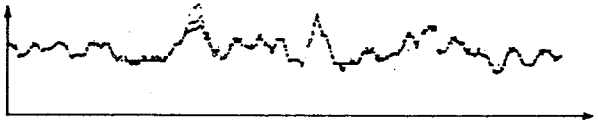
FIG. 13B
RAW R, G & B SIGNALS
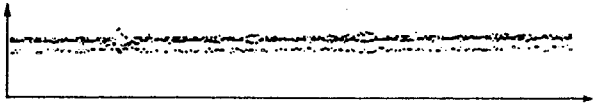
FIG. 13C
DIFFERENCES
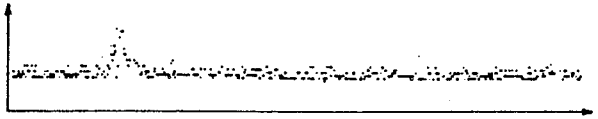
FIG. 13D
TOTAL
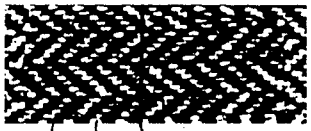
FIG. 13A

RAW R, G & B SIGNALS

DIFFERENCES

TOTAL

RAW R, G & B SIGNALS

DIFFERENCES

TOTAL

PATTERN-MATCHING SHEET-JOINING MACHINE

BACKGROUND OF THE INVENTION

This invention relates to a pattern-matching joining machine, such as a sewing machine, for joining two sheets, such as cloths, each bearing the same patterns with the patterns matching.

Published Unexamined Japanese Patent Application No. S60-153896 (which corresponds to the U.S. Pat. No. 4,612,867, and the German Patent Application No. DE 33 46 163 C1) discloses a pattern-matching sewing machine of this type. In this machine, a photo-sensor is placed before the sewing point to generate intensity data representing the brightness of the patterns on the two cloths. The mismatch distance of the patterns on the two cloths is detected using the intensity data, and the relative feed amount of the two cloths is adjusted according to the mismatch distance to maintain the pattern match.

A problem is that there are patterns that cannot be correctly adjusted by using the brightness alone. An example is a pattern including a foreground pattern of chromatic color with a low brightness (e.g., dark green) on a background pattern of a bright achromatic color and a dark achromatic color (e.g., white and black). In this case, the conventional pattern sensing method cannot accurately recognize the low-brightness chromatic color (dark green) because it is obscured by the bright achromatic pattern.

Another such pattern that cannot be recognized by the prior art method is the pattern composed by superposition of two color patterns of similar brightnesses. An example is a blue foreground pattern with a red background pattern both having similar brightnesses. In this case, one of the patterns, say the red pattern, cannot be accurately discriminated from the other (blue). Placing a red filter in the optical path between the cloth and the sensor to selectively pass the red light would be one solution. But once a color filter is fixed to the red color, the pattern sensor could not cope with other patterns having various colors: that is, the variety of cloth-patterns that could be matched would be limited.

SUMMARY OF THE INVENTION

An object of this invention is therefore to provide a pattern-matching joining machine that can match the patterns of sheets having various patterns.

A machine according to the present invention joins two sheets having the same pattern, matching the patterns on the respective sheets, and comprises, as shown in FIG. 1: first and second photo-sensing means M1 and M2 each for optically sensing the pattern on one of the sheets, and for generating intensity data for a plurality of different colors; a mismatch-detecting means M3 for calculating a mismatch distance of the patterns on the two sheets based on the intensity data of the plurality of different colors; a sheet-moving means M4 for moving the sheets according to the calculated mismatch distance to match the patterns of the two sheets; and a joining means M5 for joining the two sheets.

The first and second photo-sensing means M1 and M2 receive light from the corresponding sheets and generate intensity data for different colors. For example, they may include three independent photo-sensors sensitive to the three primary colors, R (red), G (green) and B (blue). Alternatively, each of them M1 and M2 may have a single sensor and two or more color filters that are rapidly interchanged. The first and second photo-sensing means M1 and M2 may each have a light source that projects light to the corresponding sheet. In this case, the photo-sensing means M1 or M2 has a plurality of light emitting diodes that emit particular colors, or they have color filters corresponding to particular colors between the light source and the sensors.

The mismatch-detecting means M3 calculates the mismatch distance between the two sheets based on the color intensity data of plural different colors. The colors are preferably the three primary colors of light, i.e., red (R) and green (G) and blue (B). For calculating the mismatch distance, the color intensity data are processed by, for example, following data processing means included in the mismatch-detecting means M3.

One is a subtracting means provided for each of the two sheets (or for each of the photo-sensing means). It calculates differences between the intensities of different colors. For example, when the photo-sensing means M1 and M2 detect the three primary colors, R, G and B, absolute differences between intensities of the colors, i.e. $\frac{1}{2}R—G\frac{1}{2}$, $\frac{1}{2}G—B\frac{1}{2}$ and $\frac{1}{2}B—R\frac{1}{2}$, are calculated. After taking the differences, their values may be added together to emphasize the color differences.

For a pattern such as white and black stripes with green stripes of low brightness, the green stripes can be accurately recognized by calculating the differences between the colors, because white, which contains all colors, is eliminated by the difference calculation. Therefore, the pattern-matching can be performed based on the dark green pattern.

Another data processing means in the mismatch-detecting means M3 may be a color selection means which chooses the color that has the largest intensity change. The color selection means may further have means for smoothing and means for differentiating the intensity data of each color to emphasize the intensity change. The color selection means may have secondary selection means that, when the mismatch distance calculated for the first selected color having the largest intensity change exceeds a preset allowable value, selects an alternative color having the second largest intensity change. In that case, the first selected color is, in most cases, inappropriate for using in pattern-matching. Even if the sheets have patterns that are partially misdrawn or have smears, this secondary selection means eliminates the influence of these wrong patterns or smears on the pattern-matching.

After the mismatch distance is calculated by the mismatch-detecting means M3, the sheet-moving means M4 moves one of the sheets relatively to the other to restore pattern-matching between the two sheets, and the sheets are moved together to be joined by the joining means M5. For example, the sheet-moving means M4 may consists of upper and lower sheet holders and moving mechanisms for the respective holders. When the mismatch distance is detected, one of the sheet holders are moved with respect to the other to match the patterns, and then the both holders are moved by the moving mechanisms with respect to the joining means M5 to sequentially join them.

BRIEF EXPLANATION OF THE DRAWINGS

FIGS. 12 through 15 illustrate other various example patterns and processing results of their color data.

DETAILED DESCRIPTION OF PREFERRED EMBODIMENTS

Figure 1:
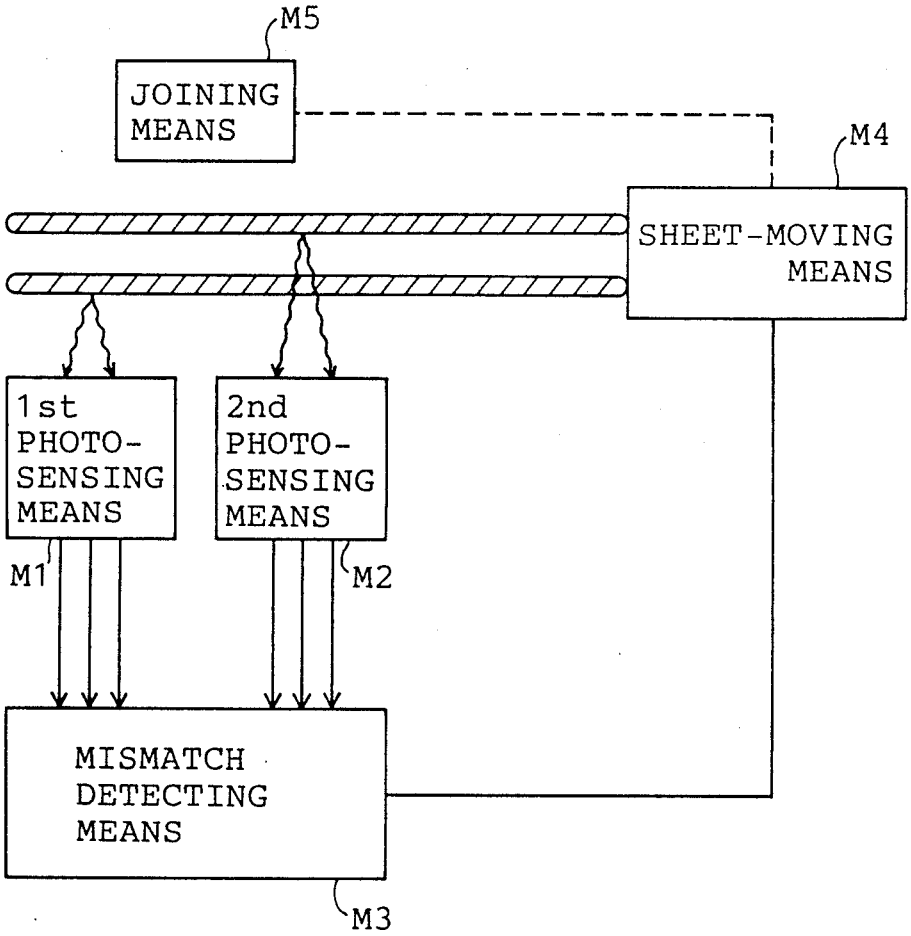
FIG. 1 is a block diagram illustrating a typical structure of a pattern-matching joining machine using this invention.
Figure 2:
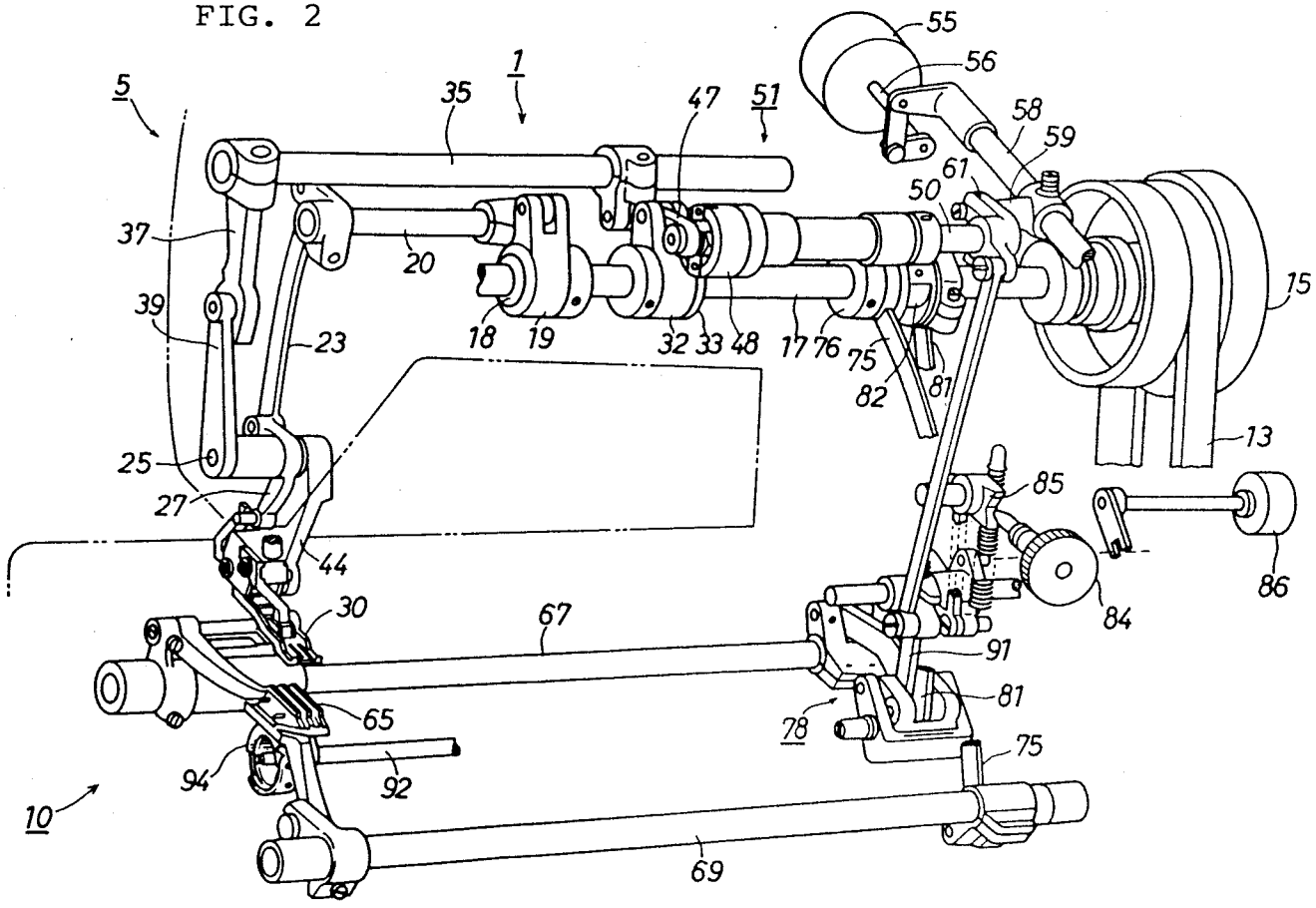
FIG. 2 schematically illustrates the mechanical structure of a sewing machine of the embodiments.

FIG. 2 illustrates a sewing machine as an embodiment of the pattern-matching joining machine. This sewing machine is controlled by a microcomputer to sew two cloths having the same pattern so their patterns match. The mechanical structure of the sewing machine is explained first.

As in FIG. 2, the sewing machine 1 includes an arm part 5 and a bed part 10 The arm part 5 includes a main shaft 17 that is driven by a main motor 190 (FIG. 4) via a belt 13 and a pulley 15. The main shaft 17 has an eccentric cam 18 that connects to a working shaft 20 via a crank rod 19. Thus the working shaft 20 rotates through a predetermined angle with the rotation of the main shaft 17 and gives a connection link 23 a vertical motion The connection link 23 connects to an arm 27 that swings about a support shaft 25. The swinging motion of the arm 27 gives an upper feed dog 30 vertical motion.

The main shaft 17 connects, via a crank rod 32, another eccentric cam 33, and a link 47, to a working shaft 35. The working shaft 35 swings through a predetermined angle according to the rotation of the shaft 17 to impart a stroke motion to levers 37 and 39. The lever 39 is articulated with an arm 44 which swings about the shaft 25. The swinging motion of the arm 44 imparts a stroke drive to the upper feed dog 30. Thus the upper feed dog 30 makes a four-motion feed: up, forward, down, and backward.

The stroke motion amount of the upper feed dog 30, i.e., the feed amount of the upper cloth, is determined by the swinging motion amount of the shaft 35. The link 47 connects to an upper feed adjuster 48 on one end of a rotary shaft 50. The adjuster 48 changes the swinging motion amount of the shaft 35 by changing the inclination of the link 47. The crank rod 32, eccentric cam 33, link 47, upper feed adjuster 48 and rotary shaft 50 form an upper feed adjusting mechanism 51.

At the other end of the shaft 50 is a rotary lever 61 with two oppositely extending arms. One arm abuts on a stopper 59 attached to a drive shaft 58 that is connected to an output shaft 56 of a step motor 55. Accordingly the step motor 55 moves the stopper 59, the stopper 59 regulates the lever 61, and the lever 61 limits the rotative angle of the shaft 50 and the swing of the shaft 35, which determines the upper feed amount.

The bed part 10 includes a horizontal feed shaft 67 and a vertical feed shaft 69 for making a lower feed dog 65 into a four-motion feed similar to the upper feed dog 30. The vertical feed shaft 69 is connected, via a crank rod 75 and an eccentric cam 76, to the main shaft 17, and rotates through a predetermined angle with the rotation of the shaft 17 to give the lower feed dog 65 a vertical motion. The horizontal feed shaft 67 is connected, via a lower feed adjuster 78, a crank rod 81, and the eccentric cam 82, to the main shaft 17, and rotates through a predetermined angle with the rotation of the main shaft 17 to give the lower feed dog 65 a horizontal motion. The lower feed adjuster 78 converts the longitudinal motion of the crank rod 81, which is driven by the rotation of the main shaft 17, to the swinging motion of the horizontal feed shaft 67, and changes the swing distance.

A manual feed control knob 84 is provided outside of the frame of the sewing machine 1 to adjust the inclination of a feed set notch 85 on which the end of the knob 84 abuts. The notch 85 is connected to the adjuster 78 via a link 91. When its inclination is changed, the feed amount is changed by the lower feed adjuster 78. The lower feed amount thus can be changed by the manual feed control knob 84. The notch 85 further connects to a potentiometer 86 that generates a signal corresponding to the lower feed amount.

Figure 3:
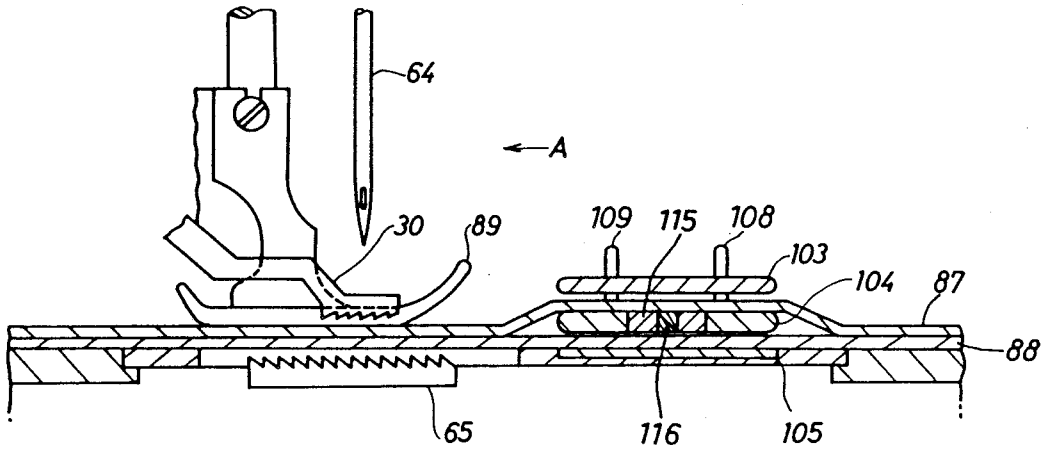
FIG. 3 illustrates the stitching section of the sewing machine.

A needle 64 (FIG. 3) is attached to a needle bar (not shown), which moves vertically synchronously with the main shaft 17. Within the bed part 10 below the needle 64 is a loop taker 94 attached to a lower shaft 92, which also rotates synchronously with the main shaft 17. Accordingly, at the sewing part (FIG. 3), synchronously with the rotation of the main shaft 17, the needle 64 and the loop taker 94 cooperate to sew together two cloths 87, 88 set under a presser foot 89, and the upper and the lower feed dogs 30 and 65 feed them in direction A (FIGS. 3 and 4) with the four-motion feed.

Upstream of the sewing part, three guide plates 103, 104, and 105 are placed in parallel to the machine bed, in which the lower guide plate 105 is embedded. Two pins 108 and 109 (FIGS. 3 and 4) stand upward on the lower guide plate 105 to penetrate long holes formed in the middle and upper plates 104 and 103, and guide the side edges of the cloths 87 and 88.

Figure 5A:
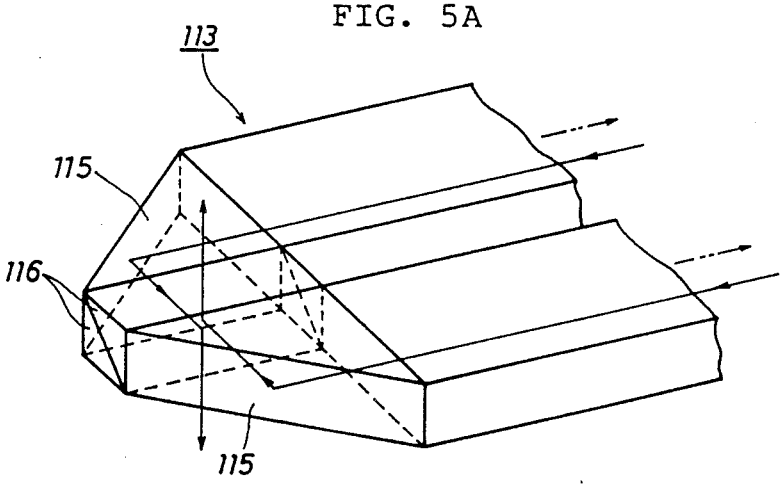
FIG. 5A illustrates an end of the pattern detector.
Figure 5B:
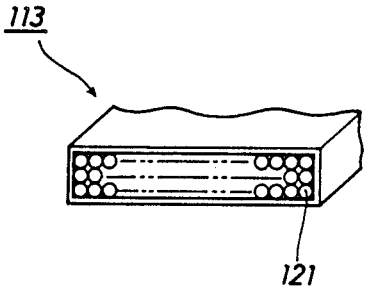
FIG. 5B illustrates an internal structure of the light conduit.

A detector 113 for detecting patterns on the two cloths 87 and 88 is embedded in the middle guide plate 104 . As shown in FIG. 5A, prisms 115 and 116 are attached at the tip of the detector 113. Light from a conduit is reflected by the prisms 115 and 116 to the cloths 87 and 88, and the light reflected by the surfaces of the cloths 87 and 88 retraces the incident path. As shown in FIG. 5B, the conduit in the detector 113 includes a bundle of optical fibers 121 that connects to a control box 124 of the sewing machine.

Figure 4:
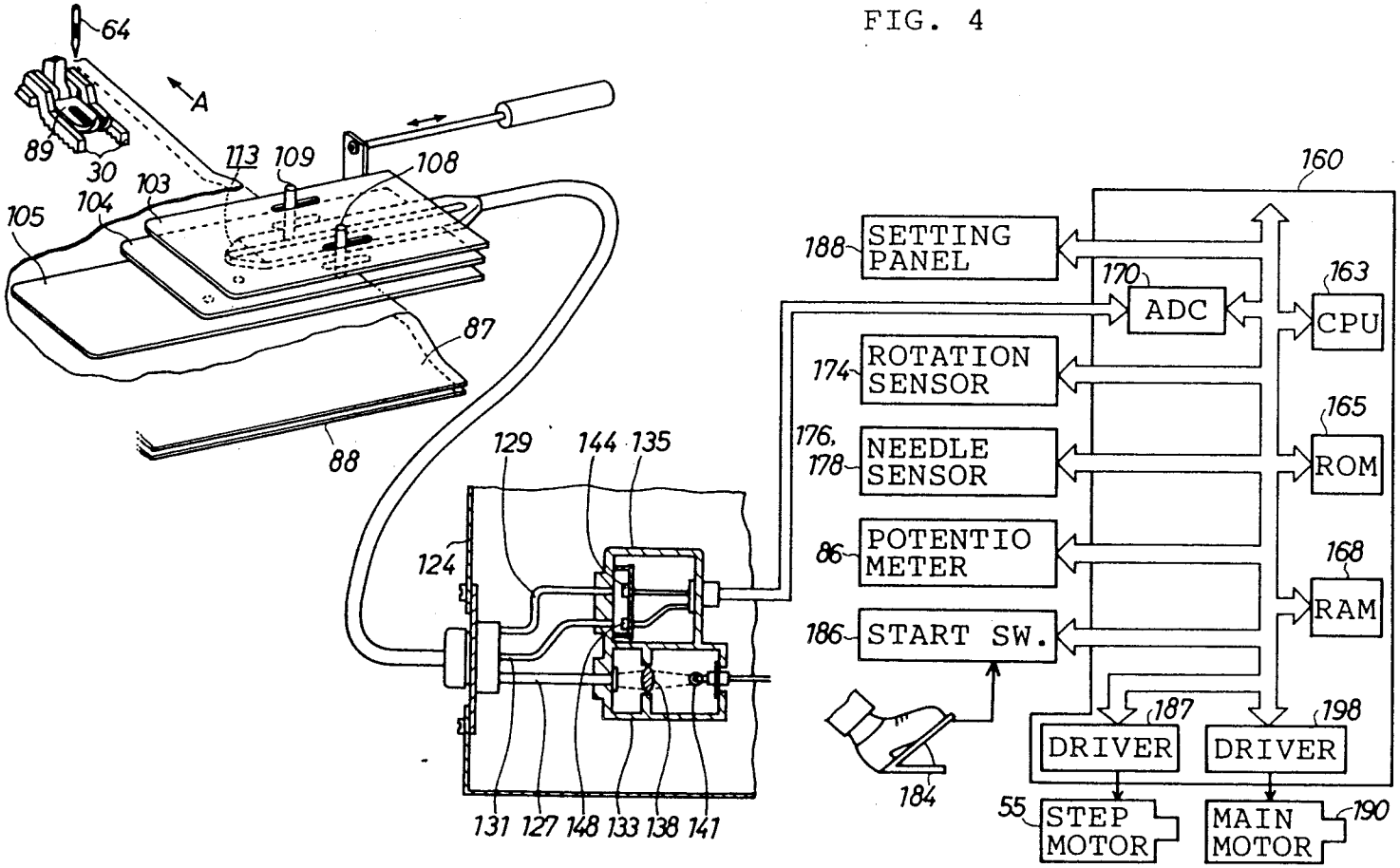
FIG. 4 illustrates the structure of a pattern detector and its control unit.

As shown in FIG. 4, the optical fibers 121 include fibers 127 (FIG. 4) for projecting the light and fibers 129 and 131 for receiving the light. The projecting fibers 127 communicate with a light source unit 133, and the receiving fibers 129 and 131 with photo-sensors 144 and 148, in the control box 124. In the light source unit 133, a lamp 141 casts white light into the fibers 127 through a lens 138. The fibers 129 and the photo-sensor 144 correspond to the upper cloth 87, and the fibers 131 and the photo-sensor 148 correspond to the lower cloth 88.

Figure 6:
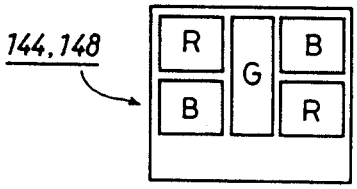
FIG. 6 illustrates an arrangement for the color filters in a photo-sensor.

As shown in FIG. 6, the photo-sensors 144 and 148 have red (R), green (G) and blue (B) color filters, and a photo diode corresponding to each color filter. Plural color filters of the same color are arranged apart so as to obtain a broader scope for receiving stray light. That is, even if the light from the fibers 129 and 131 to the sensors 144 and 148 is skewed, it can be detected by any one of the matching color filters.

The light reflected by the cloths 87 and 88 is decomposed into the three primary colors (R, G and B) by the color filters, and the intensity signal for the respective colors are generated in the photo-sensors 144 and 148. The color intensity signals are sent to an electronic control unit 160 built within the control box 124.

As shown in FIG. 4, the electronic control unit 160 is a microcomputer including a CPU (central processing unit) 163, ROM (read-only memory) 165, RAM (random access memory) 168, an analog-to-digital converter (ADC) 170, and driver circuits 187 and 198. The ADC 170 connects to the photo-sensors 144 and 148, the driver circuit 187 to the upper-feed adjusting step motor 55, and the drive circuit 198 to the main motor 190 of the sewing machine. The electronic control unit 160 also connects to: a rotation sensor 174 on the pulley 15 for generating twenty-four (24) pulse signals per rotation of the main shaft 17; needle position sensors 176 and 178 also on the pulley 15 for generating low-position and high-position signals, respectively, for the needle position; the potentiometer 86 for detecting the lower feed amount; a start switch 186 at a pedal 184 for generating start and stop signals for sewing; and a setting panel 188 for setting the pattern-setting parameters according to patterns on the cloths 87 and 88.

Figure 7:
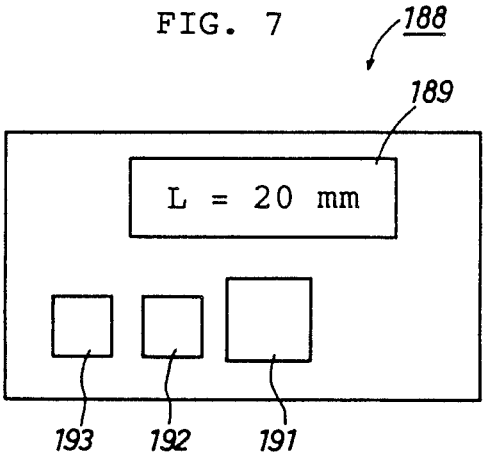
FIG. 7 illustrates a setting panel.

As shown in FIG. 7, the setting panel 188 includes a liquid crystal display 189, a changing key 191 for initiating a change of the preset length for the control of mismatch distance calculation, and an increment key 192 and a decrement key 193 for increasing and decreasing the length when the changing key 191 is operated. A control routine for pattern matching is stored in the ROM 165. The pattern matching control routine of the sewing machine is now described.

Figure 8A:
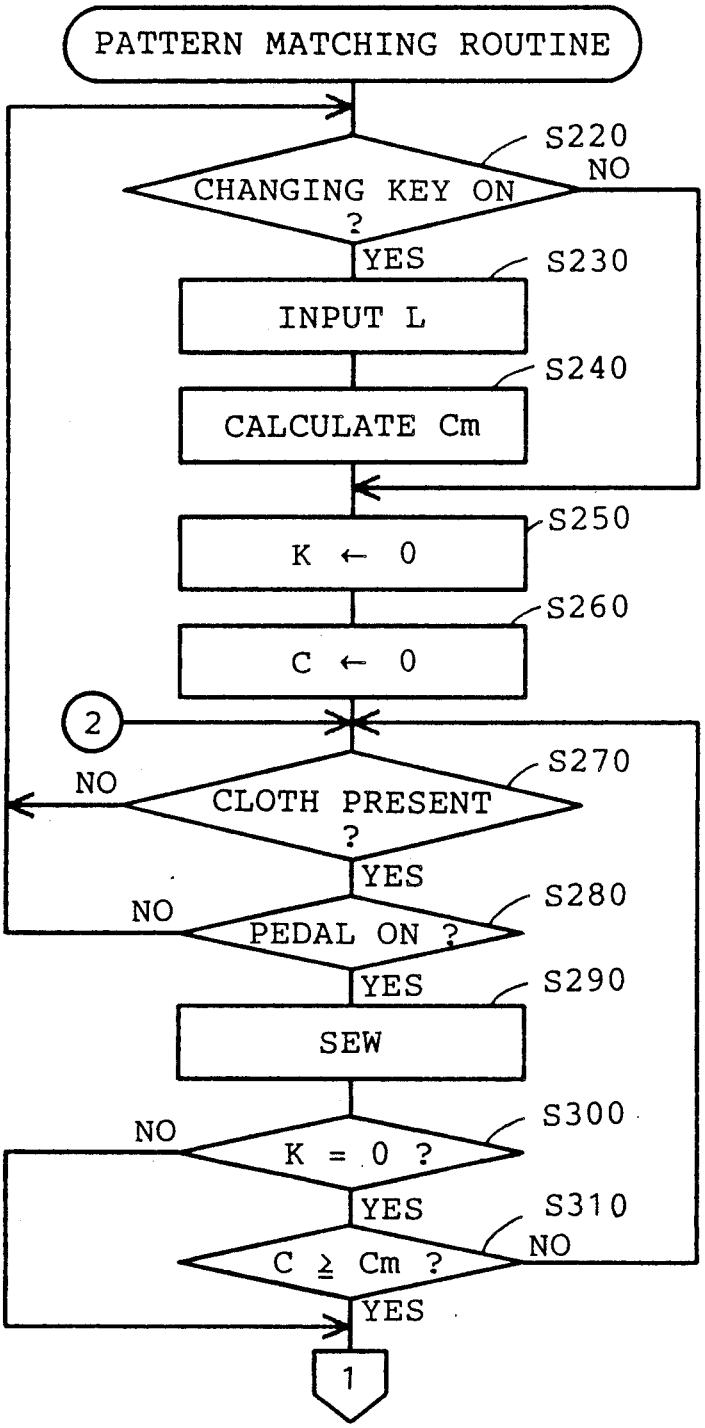
FIGS. 8A and 8B are flowcharts of a pattern matching control routine.
Figure 8B:
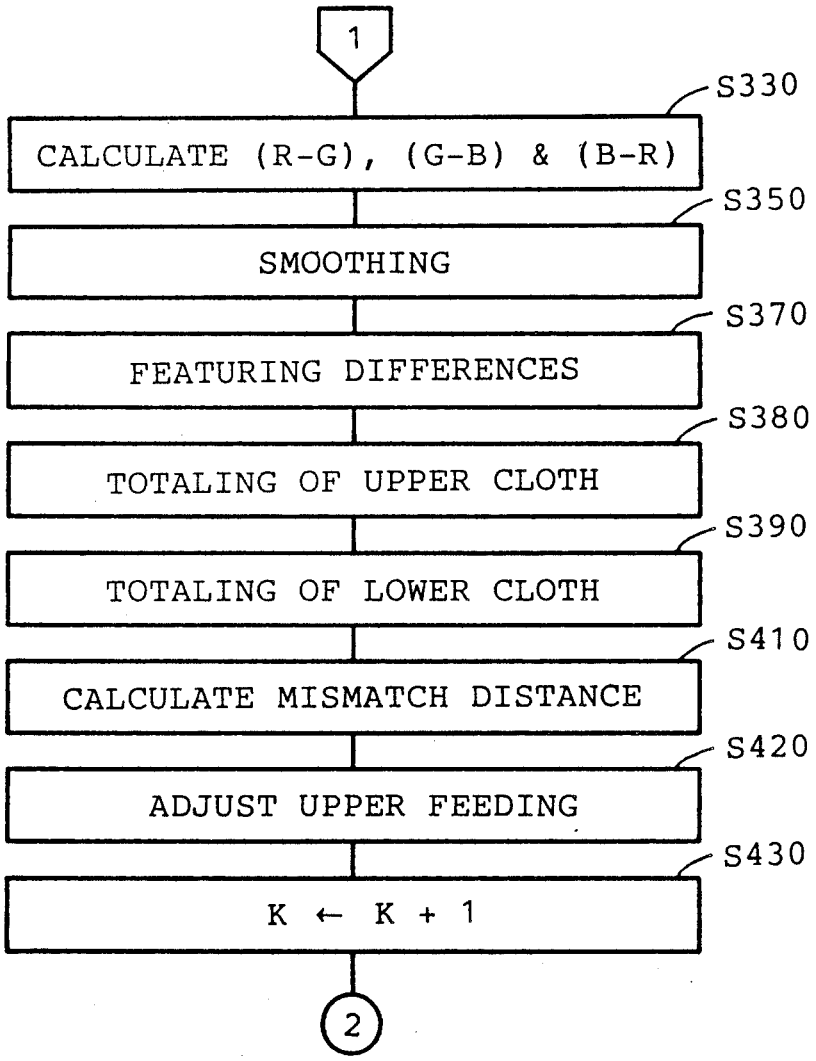
Figure 9:
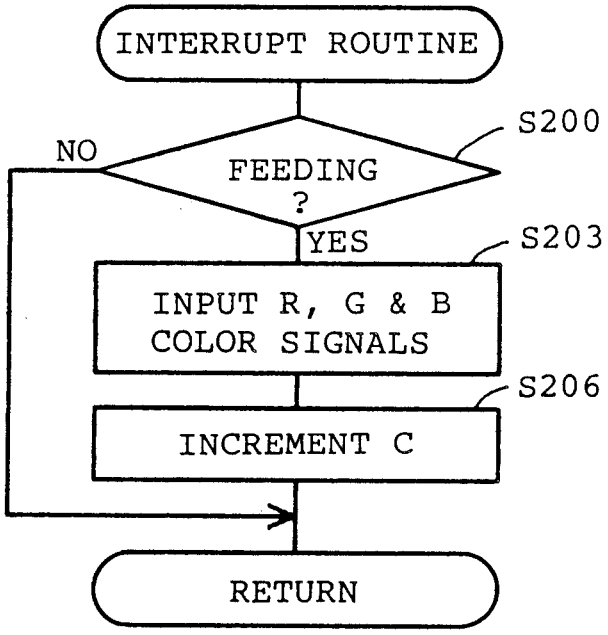
FIG. 9 is a flowchart of an interrupt processing routine.

FIGS. 8A and 8B are flow charts for a pattern matching control routine, and FIG. 9 is a flowchart of an interrupt processing routine. A value of the preset length that was set on the setting panel 188 before the power was turned off is preserved by a backed-up memory, and, when the power of the sewing machine is turned on, the stored value becomes the initial value. When the sewing machine is used for the first time, or if it has not been used for a long time, the preset length L is set at 20 mm, and a reference number Cm is determined based on the length L and the lower feed amount output from the potentiometer 86. When cloths different from those handled before are to be sewn, the operator turns on the changing key 191, and pushes the increment or decrement key 192 or 193 to set a new length L corresponding to the new pattern. Normally the length L is set slightly longer than the recurring distance of the pattern, and L should be longer than the largest solid (or unpatterned) segment of the pattern to detect any intensity change.

Figure 10:
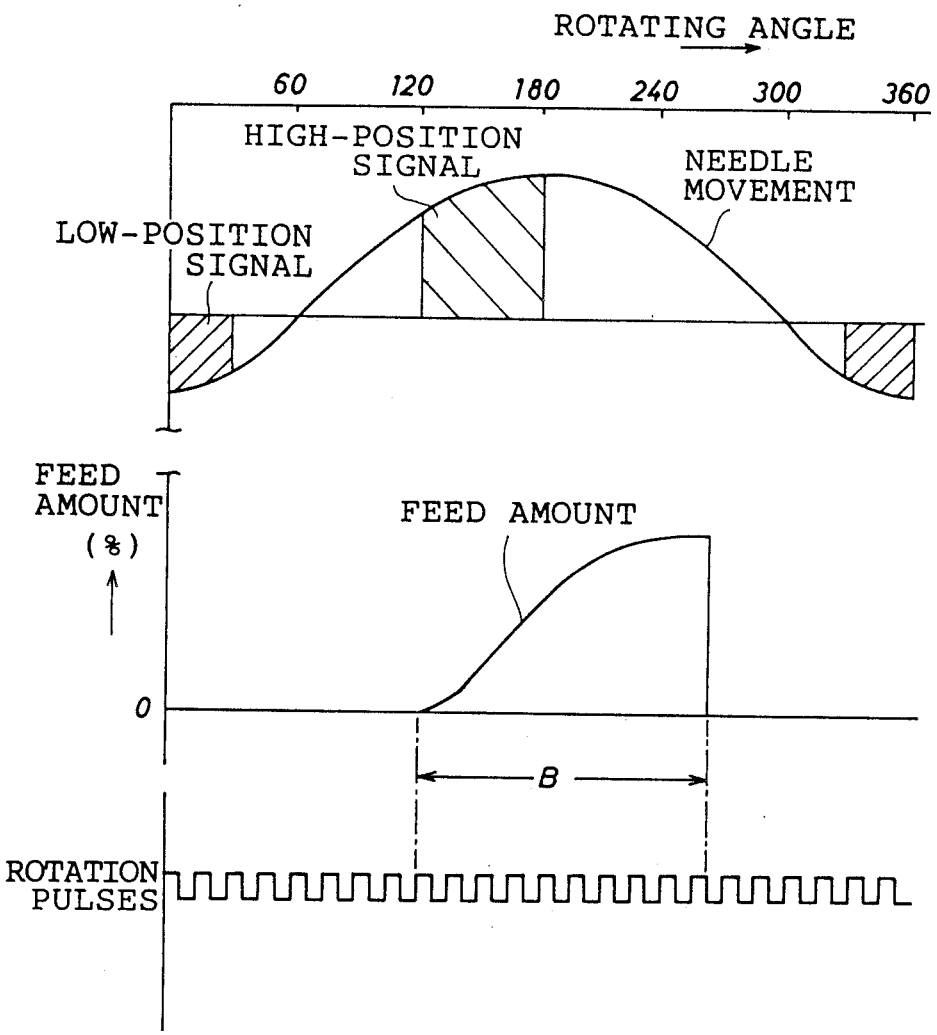
FIG. 10 is a graph illustrating a needle position, feed amount and pulse signals generated by a rotation sensor.

First, the interrupt processing routine (FIG. 9) is explained. This routine is started at every falling edge of the rotation pulse signal from the rotation sensor 174. As shown in FIG. 10, the rotation sensor 174 generates twenty-four (24) pulse signals during a rotation of the main shaft 17, so that each time the main shaft 17 rotates through fifteen (15) degrees, the routine is executed.

In the interrupt processing routine, it is first examined, at step S200, whether the pulse signal from the rotation sensor 174 is within a cloth feeding movement (B in FIG. 10). If not, the routine ends. If the pulse signal from the rotation sensor 174 is within the feeding movement, six color intensity data (red, green and blue intensity data from the upper cloth 87 and the lower cloth 88) sensed by the photo sensors 144 and 148 are converted to digital signals by the ADC 170 and are stored as one set of color data in the RAM 168 (step S203). A counter C for the color data set is incremented by one at step S206, and this routine ends.

The pattern matching control routine is now explained with FIGS. 8A and 8B. This routine is executed at a preset time interval. First the state of the changing key 191 is examined at step S220. When the key 191 is not turned on, the length L is not changed and the process goes to step S250. When the key 191 is turned on, the length L set by the operator is input at step S230, and the reference number Cm is calculated at step S240. The number Cm represents the number of color data sets corresponding to the length L, and is calculated as follows:

$$Cm = Np.L/Df;$$

where Np is the number of pulses in the feeding range and Df is the feed amount. For example, when the length L is set at 30 mm and the feed amount is 1 mm, Cm is calculated as 10 (pulses)$\times$30 (*mm*)/1 (*mm*)=300, since the number of pulse signals is 10 (pulses) per main shaft rotation in the feeding stage.

Subsequently, a control counter K and the counter C for the color data sets stored in the RAM 168 are cleared at zero at steps S250 and S260. Then, the CPU 163 waits until the upper and lower cloths 87 and 88 are set and the pedal 184 is pressed at steps S270 and S280, respectively, at which time the CPU 163 drives the machine main motor 190 to start sewing at step S290.

While the main motor 190 rotates during sewing, the interrupt processing routine (FIG. 9) is repeatedly executed and the color data sets are sequentially stored in a predetermined data area of the RAM 168. When the control counter K is 0 and the number of color data sets C is less than the calculated reference number Cm at steps S300 and S310, respectively, the process returns to step S270, while the sewing continues. When the number C reaches Cm, the pattern matching processing in FIG. 8B is executed.

Figure 11A:
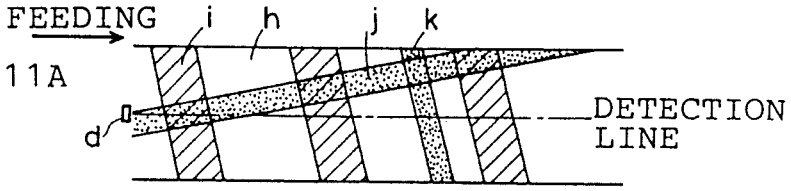
FIGS. 11A through 11G illustrate an example pattern and processing results of its color data.
Figure 11B:
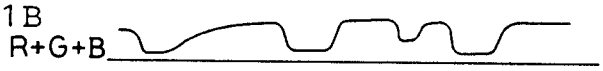
Figure 11C:
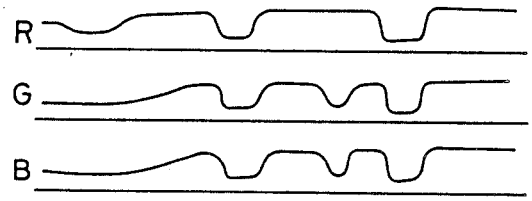

In the pattern matching processing, calculations are performed based on the latest Cm number of color data sets. As shown in FIG. 11A, the cloths 87 and 88 have the same pattern: a check of thick j and thin k red-lines over stripes of white h and black i. The thick red-line j lies almost longitudinal to the direction the cloths move and the thin red-line k lies almost transverse to that movement. The small region d is the photo-detection area. The intensity of the brightness of the pattern is shown in FIG. 11B, and the intensities of the three colors (R, G and B) are separately shown in FIG. 11C.

Figure 11D:
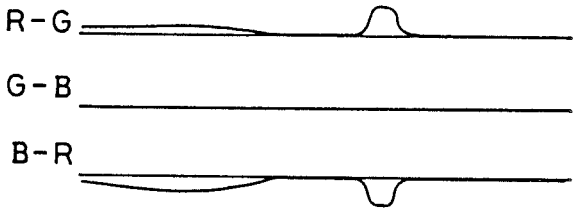

First, Cm color data sets are read from the RAM 168, and differences between three primary colors (R−G), (B−R) and (G−B) are calculated at step S330. The differences are shown in FIG. 11D. By these difference calculations, color components having equal intensities are removed. Since achromatic color, such as the white h and the black i of the cloth pattern, develops intensities equal to the three primary colors R, G and B, such black and white stripes do not affect the difference data.

Figure 11E:
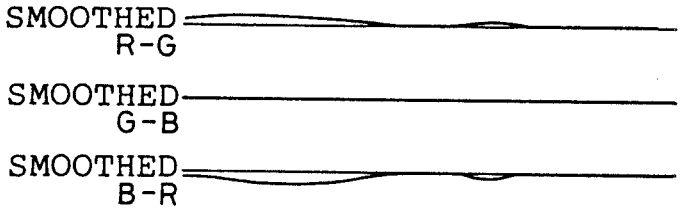

Then a smoothing ("averaging" in the claim terminology) operation is performed for each point of the difference data at step S350. The smoothing operation for a point is done by adding data of 125 points from before and after that point to the data of that point, and dividing the sum by 251 (=125+1+125) to obtain smoothed data for that point. The result is shown in FIG. 11E. This smoothing operation flattens the acute peaks due to the transverse red lines k but the gentle curves due to the longitudinal red lines j remain almost unchanged.

Figure 11F:
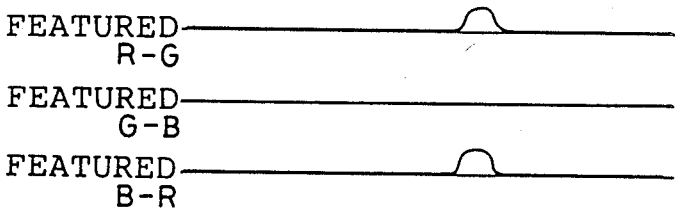
Figure 11G:
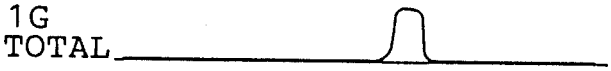
Figure 14B:
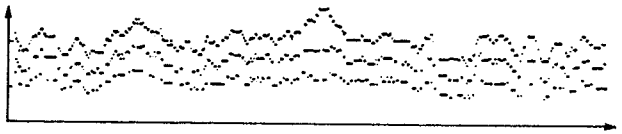
Figure 14C:
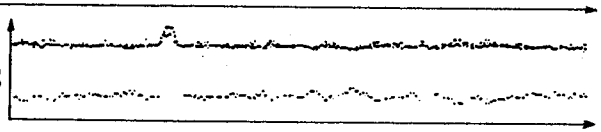
Figure 14D:
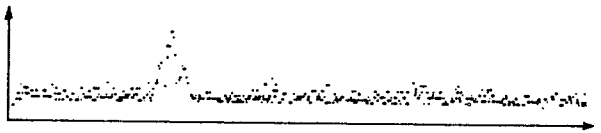
Figure 15B:
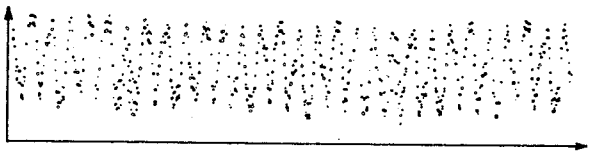
Figure 15C:
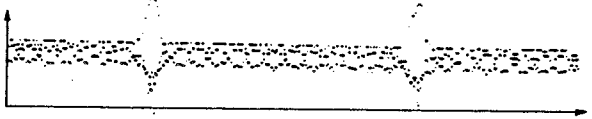
Figure 15D:
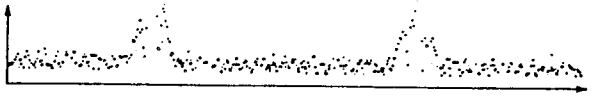
Figure 14A:
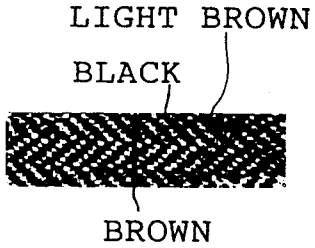
Figure 15A:
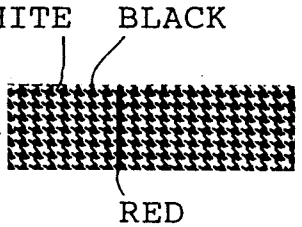

Then featuring differences between the smoothed curves and the unsmoothed original curves are calculated at step S370. This featuring difference operation eliminates the gentle curves due to the longitudinal red lines j, but the acute peaks due to the transverse red lines k remain. Absolute values of the featuring difference curves are shown in FIG. 11F. Further, absolute values of the featuring difference data of the three primary colors are added together at steps S380 and S390 to get emphasized-difference data in which the acute peaks of the transverse red lines k are emphasized. This result is shown in FIG. 11G. Examples of patterns, color data, difference data and the emphasized-difference data for various cloth patterns are given in FIG. 12 through FIG. 15.

Based on this emphasized-difference data calculated from the color data from the upper and lower cloths 87 and 88, the mismatch distance between the two cloths 87 and 88 is calculated at step S410, and the step motor 55 is driven to adjust the feed of the upper cloth 87 to match the patterns so that the positions of the same pattern colors on each of the sheets coincide with each other at step S420.

After the adjustment of the feed of the upper cloth 87, the control counter K is incremented by 1 and the routine ends here.

As explained above, in this embodiment, the light from the upper and lower cloths 87 and 88 is decomposed into three primary colors, R, G and B, and the differences between the intensities of the three colors are calculated to remove the influence of patterns of achromatic color. Then the difference data has smoothing-processed data of itself subtracted in order to remove the influence of longitudinal (with respect to the feeding direction) stripes. Further, featured differences of the three colors are added together to emphasize the influence of pattern of the chromatic color, and the mismatch distance is calculated based on that emphasized data.

Therefore, according to this embodiment, accurate pattern matching can be performed for patterns having stripes of bright achromatic color and dark achromatic color with stripes of chromatic color of low brightness by skillfully extracting the position of the chromatic color.

Another embodiment of the invention is now explained. This embodiment corresponds to the second feature of the invention in which the color data that has the largest intensity change is selected. This embodiment is also a pattern-matching sewing machine, and uses the same hardware as the first embodiment as shown in FIGS. 2 through 7. Processing stored in the ROM 165 and executed by the CPU 163 is now explained.

The interrupt routine of FIG. 9 is also executed in this embodiment and the first part of the pattern-matching routine of this embodiment is the same as that shown in FIG. 8A.

Figure 16:
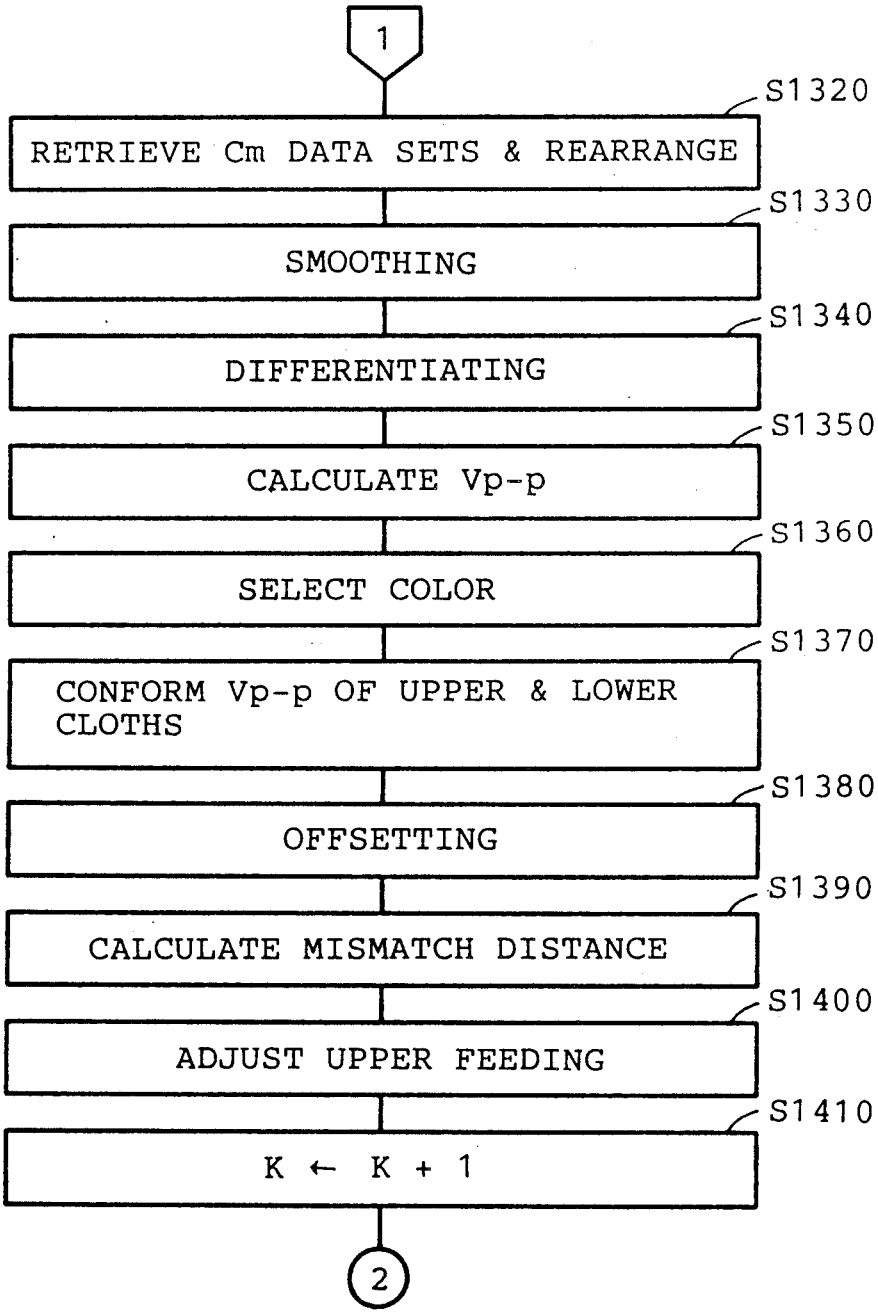
FIG. 16 is a flowchart segment replacing FIG. 8B in the second embodiment of the invention.

When K=0 and the number C reaches Cm, or when the control counter K is 1 or more, the pattern matching processing in FIG. 16 (instead of FIG. 8B) is executed.

Figure 17A:
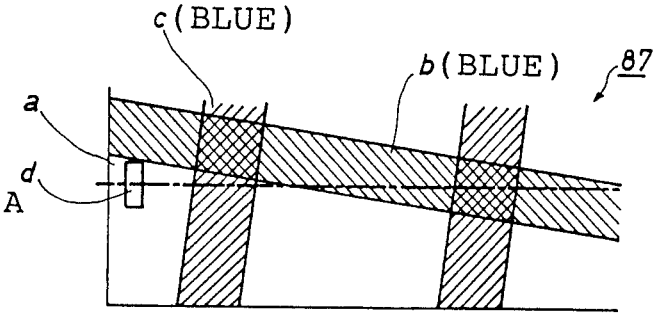
FIGS. 17A and 17B illustrate an example pattern for the second embodiment and its color data for an upper cloth.
Figure 18A:
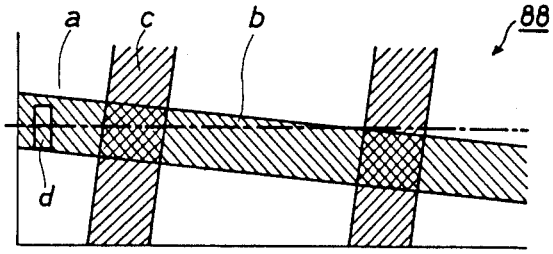
FIGS. 18A and 18B illustrate the example pattern and its color data for a lower cloth.

Now the case where the upper and lower cloths 87 and 88 having the same pattern are mismatched, as shown in FIGS. 17A and 18A, is explained. The pattern is composed of a gray background (gray cloth) a with a check of longitudinal (with respect to the feeding direction) b and transverse c blue lines. Both blue colors of the check pattern have equal brightness to the gray cloth color, so special treatment is necessary to distinguish the blue check pattern from the background color in the pattern matching. Further, the pattern matching is better for the transverse lines c than for the longitudinal lines b.

Figure 17B:
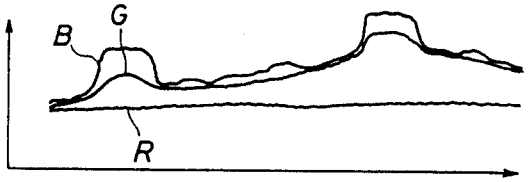
Figure 18B:
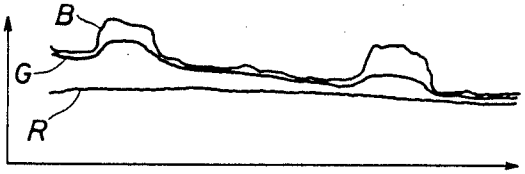

Reference letter d in FIG. 17A and 18A designates the area of photo-detection. After Cm sets of color data are collected by the photo-sensor system at step S310 (FIG. 8A), the latest Cm color data sets are retrieved from the RAM 168 at step S1320 and the subsequent data processing, as shown in FIG. 16, is done on those data sets. The retrieved data are rearranged into six data sequences, each respectively corresponding to red (R), green (G), and blue (B) intensity data sequences for the upper cloth 87; and red (R), green (G), and blue (B) for the lower cloth 88. The data sequences are shown in FIGS. 17B and 18B.

Figure 19A:
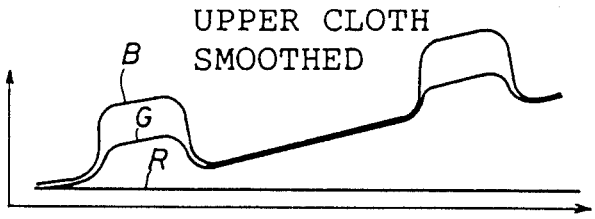
FIGS. 19A and 19B are graphs showing the smoothed data.
Figure 19B:
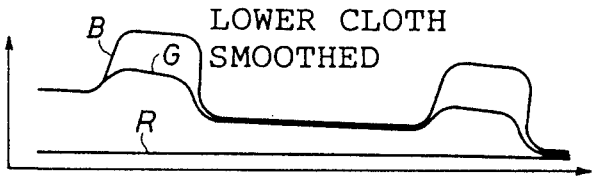

Then a smoothing (averaging) operation is performed for every point of each data sequence at step S1330. That is, intensity data of 21 points from before and after a point is added to the intensity data of that point, and the sum is divided by 43 (=21+1+21) to obtain the smoothed data for that point. FIGS. 19A and 19B show the smoothed data.

Figure 20A:
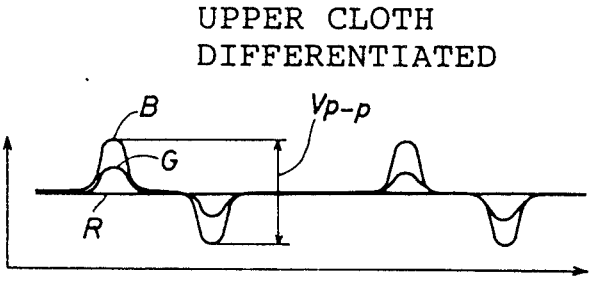
FIGS. 20A and 20B are graphs showing the differentiated data.
Figure 20B:
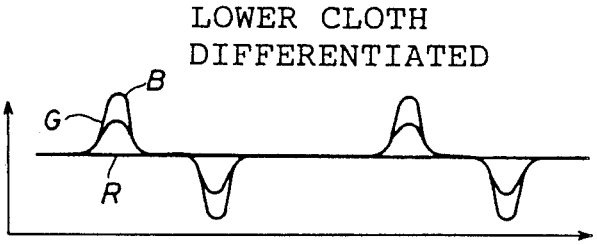

The smoothed data is then differentiated at step S1340. The results are shown in FIGS. 20A and 20B, which show that the differentiating operation emphasizes the acute changes and moderates gentle changes in the smoothed data. Therefore, a gentle change caused by the longitudinal line b is removed from the differentiated data.

In the subsequent step S1350, a peak height Vp-p between the maximum and minimum peak values of the differentiated data for each color of the upper and lower cloths 87 and 88 is calculated.

The peak heights Vp-p of the upper and the lower cloths 87 and 88 are added for each of the three colors R, G and B, and the color with the largest sum is selected at step S1360. In FIGS. 20A and 20B, the blue (B) color makes the largest sum, i.e., has the largest intensity change, so the blue color is selected.

The differentiated data (of the selected blue color) of either the upper and lower cloths is amplified as necessary so that their peak heights Vp-p become equal at step S1370. Then, an offset processing is performed at step S1380: an average value of all points is subtracted from each point so that the average value of the blue differentiated data becomes 0.

Figure 21:
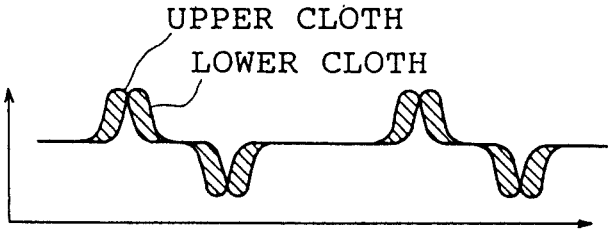
FIG. 21 illustrates the superposition of differentiated-data peaks for the upper and lower cloths.
Figure 22A:
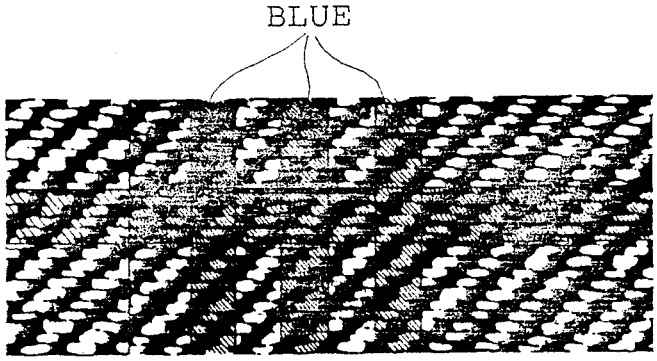
FIGS. 22A, 22B and 22C illustrate another example pattern and its data processing results.
Figure 22B:
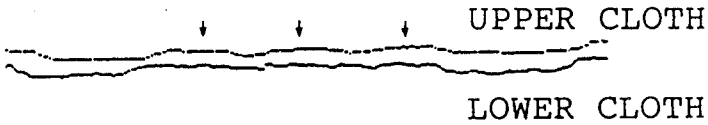
Figure 22C:
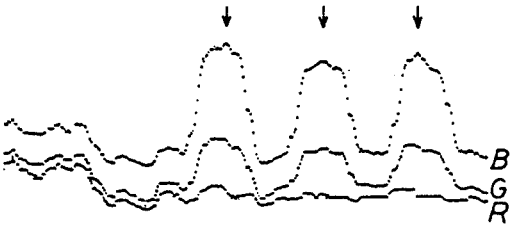

Then the mismatch distance is calculated based on the offset-processed data at step S1390. Specifically, the offset-processed differentiated data of the upper and lower cloths 87 and 88 are superposed as shown in FIG. 21, and the difference area of the two curves (shaded in FIG. 21) is measured. The differentiated data are shifted in the data feed direction, and when the difference area becomes minimum, that shifted distance is the mismatch distance The step motor 55 is driven according to the calculated mismatch distance to adjust the upper-feed amount at step S1400. When the adjustment of the upper-feed amount is completed, the control counter K is incremented by one at step S1410 and the present routine ends When cloths having another pattern as shown in FIG. 22A are sewn in the prior art sewing machine, the photo-intensity data from the upper and lower cloths are, as shown in FIG. 22B, very plain so that a successful pattern matching would be difficult. On the other hand, the sewing machine of this embodiment detects the pattern in three colors, as shown in FIG. 22C, and the most suitable color is selected for the pattern matching (blue in the last case) so that a correct pattern matching can be made in sewing.

Figure 23:
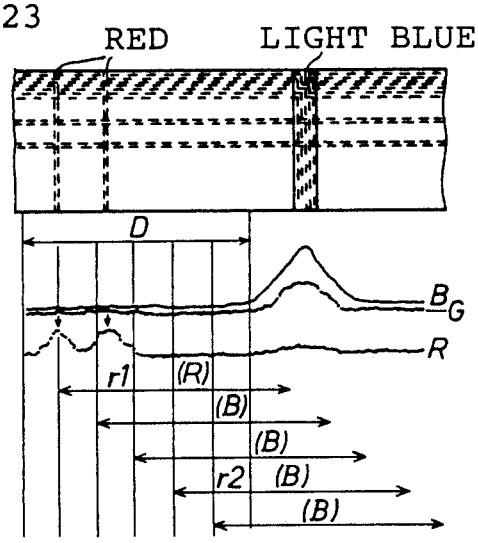
FIG. 23 illustrates still another example pattern and its color data.

FIG. 23 illustrates still another pattern with the three primary-color intensity data for the pattern to show how the color is selected for each preset length L. In this case, if the preset length L (step S230 in FIG. 8A) is set at D in FIG. 23, red (R) is selected in the range r1, and blue (B) is selected in the range r2.

As shown above, the sewing machine of this embodiment decomposes the light reflected by the upper and lower cloths 87 and 88 into three primary colors (R, G and B), selects the color having the largest intensity change, and calculates the mismatch distance based on the selected color data. Therefore, patterns that have different colors but brightnesses similar to the background can be preferentially extracted to make an accurate pattern matching Another advantage is that the most suitable color is selected for each Cm data sets corresponds to the preset length L so that, without changing color filters, any color change or a pattern change in sewing can be successfully handled.

In the second embodiment, before the color selection and mismatch distance calculation, the raw color data from the photo-sensors 144 and 148, are first smoothed and differentiated. Therefore, an instantaneous change in the color data, such as by smears on the pattern, or a slow change in the color data, such as caused by almost-longitudinal stripes, can be eliminated to improve pattern matching accuracy.

If the changes in the intensity of different color data are equal (e.g., when the peak heights Vp-p for R and G are equal), the color selection may be performed according to a predetermined order of priority.

For the improvement of the data processing speed, the differentiating process may be omitted when the cloths have no longitudinal patterns, or the smoothing process may be omitted when the patterns can be clearly discriminated in brightness from each other.

This invention is not limited to the details of above embodiments and various changes and modifications are possible without departing from the spirit and scope of the invention. For example, the joining may be made by, instead of sewing, ultrasonic joining which melts two plastic sheets with ultrasonic vibrations. Further, the pattern matching method of this invention is applicable to a color mark sensor that detect a position of a mark having only a slight color difference from its background.

What is claimed is:

1. A machine for joining two sheets, the sheets each having identical color patterns thereon, so that the positions of the same color patterns on each of the sheets coincide with each other comprising:

first and second photo-sensing means each for optically sensing a color pattern on one of the sheets, and for generating intensity data for a plurality of different colors;

a mismatch-detecting means for calculating a mismatch distance of the patterns on the two sheets based on the intensity data for the plurality of different colors;

a sheet-moving means for moving the sheets according to the calculated mismatch distance to match the patterns of the two sheets; and a joining means for joining the two sheets.

2. A sheet-joining machine, as in claim 1, where the mismatch-detecting means comprises first and second subtracting means each for calculating differences between the intensity data for different colors generated by the respective photo-sensing means.

3. A machine for joining two sheets, the sheets each having identical color patterns thereon, so that the positions of the same color patterns on each of the sheets coincide with each other comprising:

first and second photo-sensing means each for optically sensing a color pattern on one of the sheets, and for generating intensity data for a plurality of different colors;

a mismatch-detecting means for calculating a mismatch distance of the patterns on the two sheets based on the intensity data for the plurality of different colors comprising first and second subtracting means each for calculating differences between the intensity data for different colors generated by the respective photo-sensing means and first and second color selection means each for selecting the color intensity data that has the largest change in the intensity;

a sheet-moving means for moving the sheets according to the calculated mismatch distance to match the patterns of the two sheets; and a joining means for joining the two sheets.

4. A sheet-joining machine, as in claim 1, where each of the first and second photo-sensing means includes color filters and photo-electrical transducers corresponding to the plurality of different colors.

5. A sheet-joining machine, as in claim 4, where each of the first and second photo-sensing means consists of red, green and blue photo-sensors each respectively including a color filter and a photo-diode.

6. A sewing machine for sewing two sheets, the sheets each having identical color patterns thereon, so that the positions of the same color patterns on each of the sheets coincide with each other comprising:

a stitch forming means including a needle;

first and second feeding means for feeding one of the sheets;

first and second photo-sensing means each for optically sensing a color pattern on one of the sheets during feeding, and for generating intensity data for a plurality of different colors;

a mismatch-detecting means for calculating a mismatch distance of the patterns on the two sheets based on the intensity data for the plurality of different colors; and a feed adjusting means for adjusting at least one of the feeding means to match the patterns, based on the calculated mismatch distance.

7. A sewing machine, as in claim 6, where the mismatch-detecting means comprises first and second subtracting means each for calculating differences between the intensity data for different colors generated by the respective photo-sensing means.

8. A sewing machine for sewing to sheets, the sheets each having identical color patterns thereon, so that the positions of the same color patterns on each of the sheets coincide with each other comprising:

a stitch forming means including a needle;

first and second feeding means each for feeding one of the sheets;

first and second photo-sensing means each for optically sensing a color pattern on one of the sheets during feeding, and for generating intensity data for a plurality of different colors;

a mismatch-detection means for calculating a mismatch distance of the patterns on the two sheets based on the intensity data for the plurality of different colors comprising first and second color selection means each for selecting the color intensity data that has the largest change in the intensity; and a feed adjusting means for adjusting at least one of the feeding means to match the patterns, based on the calculated mismatch distance.

9. A sewing machine, as in claim 6, where each of the first and second photo-sensing means includes color filters and photo-electrical transducers corresponding to the plurality of different colors.

10. A sewing machine, as in claim 9, where each of the first and second photo-sensing means consists of red, green, and blue photo-sensors, each respectively including a color filter and a photo-diode.

11. A machine for joining two sheets, the sheets each having identical color patterns thereon, so that the positions of the same color patterns on each of the sheets coincide with each other comprising:

first and second feeding means each for feeding one of the sheets;

first and second photo-sensing means for optically sensing a color pattern on one of the sheets during feeding and for generating intensity data for a plurality of different colors for a plurality of points on the sheet;

first and second subtracting means each for calculating differences between the intensity data for different colors generated by the respective photo-sensing means;

a mismatch-detecting means for calculating a mismatch distance for the patterns on the two sheets based on the calculated differences; and a feed adjusting means for adjusting at least one of the feeding means to match the patterns, based on the calculated mismatch distance.

12. A sheet-joining machine, as in claim 11, where each of the first and second photo-sensing means senses the pattern while the sheets are fed for a preset length, and the mismatch-detecting means calculates the mismatch distance after every feeding of the preset length.

13. A sheet-joining machine, as in claim 11, where each of the first and second photo-sensing means generates red, blue, and green color intensity data, and each of the first and second subtracting means calculates the differences between the red and blue, between the blue and green, and between the green and red color intensity data.

14. A machine for joining two sheets, the sheets each having identical color patterns thereon, so that the positions of the same color patterns on each of the sheets coincide with each other comprising:

first and second feeding means each for feeding one of the sheets;

first and second photo-sensing means each for optically sensing a color pattern on one of the sheets during feeding and for generating intensity data for a plurality of different colors for a plurality of points on the sheet, each of the first and second photo-sensing means generating red, blue, and green color intensity data;

first and second subtracting means each for calculating differences between the intensity data for different colors generated by the respective photo-sensing means, each of the first and second subtracting means calculating the differences between the red and blue, between the blue and green, and between the green and red color intensity data;

first through sixth averaging means each for averaging one of the three difference data generated by one of the subtracting means, the averaging for each point being performed by first adding values of data for several points before and after the point to the value of data for that point, and then dividing the sum by the number of the points added together;

first through sixth featuring means each for calculating a featuring difference which is a difference between the difference generated by the respective subtracting means and the averaged difference calculated by the respective averaging means;

a mismatch-detecting means for calculating a mismatch distance for the patterns on the two sheets based on the calculated differences;

first and second totaling means each for totaling the three featuring differences corresponding to one of the sheets, by which the mismatch-detecting means calculates the mismatch distance; and a feed adjusting means for adjusting at least one of the feeding means to match the patterns, based on the calculated mismatch distance.

15. A machine for joining two sheets, the sheets each having identical color patterns thereon, so that the positions of the same color patterns on each of the sheets coincide with each other comprising:

first and second feeding means each for feeding one of the sheets;

first and second photo-sensing means each for optically sensing a color pattern on one of the sheets during feeding and for generating intensity data for a plurality of different colors for a plurality of points on the sheet;

first and second color selection means each for selecting the color intensity data that has the largest change in the intensity;

a mismatch-detecting means for calculating a mismatch distance for the patterns on the two sheets based on the selected color intensity data; and a feed adjusting means for adjusting at least one of the feeding means to match the patterns, based on the calculated mismatch distance.

16. A sheet-joining machine, as in claim 15, where: each of the first and second photo-sensing means senses the pattern while the sheets are fed for a preset length;

each of the first and second color selection means selects one of the color intensity data every said preset length; and the mismatch-detecting means calculates the mismatch distance after every said preset length.

17. A sheet-joining machine, as in claim 15, where each of the first and second photo-sensing means generates red, blue, and green color intensity data.

18. A sheet-joining machine, as in claim 17, where each of the first and second color selection means comprises:

first through third averaging means each for averaging one of the three color intensity data generated by the respective photo-sensing means, the averaging for each point being performed by first adding values of data for several points before and after the point to the value of data for that point, and then dividing the sum by the number of the points added together;

first through third differentiating means each for calculating a differential for each of the respective averaged color intensity data; and a color selecting means for selecting the differentiated color intensity data that has the largest peak-to-peak height.

19. A machine for joining the two sheets, the sheets each having identical color patterns thereon, so that the positions of the same color patterns on each of the sheets coincide with each other comprising a joining means for joining the two sheets;

a feeding means for feeding the two sheets into the joining means;

first and second photo-sensing means each for optically sensing a color pattern on one of the sheets during feeding, and for substantially simultaneously generating intensity data for a plurality of different colors;

a mismatch-detecting means for calculating a mismatch distance of the patterns on the two sheets based on the intensity data for the plurality of different colors; and a sheet-moving means for moving at least one of the sheets according to the calculated mismatch distance to match the patterns of the two sheets.

20. A sheet-joining machine, as in claim 19, where the mismatch-detecting means comprises first and second subtracting means each for calculating differences between the intensity data for different colors generated by the respective photo-sensing means.

21. A sheet-joining machine, as in claim 19, where the mismatch-detecting means further comprises first and second color selection means each for selecting the color intensity data that has the largest change in the intensity.

22. A sheet-joining machine, as in claim 19, where each of the first and second photo-sensing means includes color filters and photo-electrical transducers corresponding to the plurality of different colors.

23. A sheet-joining machine, as in claim 22, where each of the first and second photo-sensing means consists of red, green and blue photo-sensors each respectively including a color filter and a photo-diode.

24. A sewing machine for sewing two sheets, the sheets each having identical color patterns thereon, so that the positions of the same color patterns on each of the sheets coincide with each other comprising:

a stitch forming means including a needle;

first and second feeding means each for feeding one of the sheets into the stitch forming means;

first and second photo-sensing means each for optically sensing a color pattern on one of the sheets during feeding, and for substantially simultaneously generating intensity data for a plurality of different colors;

a mismatch-detecting means for calculating a mismatch distance of the patterns on the two sheets based on the intensity data for the plurality of different colors; and a feed adjusting means for adjusting at least one of the feeding means to match the patterns, based on the calculated mismatch distance.

25. A sewing machine, as in claim 24, where the mismatch-detecting means comprises first and second subtracting means each for calculating differences between the intensity data for different colors generated by the respective photo-sensing means.

26. A sewing machine, as in claim 24, where the mismatch-detecting means further comprises first and second color selection means each for selecting the color intensity data that has the largest change in the intensity.

27. A sewing machine, as in claim 24, where each of the first and second photo-sensing means includes color filters and photo-electrical transducers corresponding to the plurality of different colors.

28. A sewing machine, as in claim 27, where each of the first and second photo-sensing means consists of red, green, and blue photo-sensors, each respectively including a color filter and a photo-diode.

29. A machine for joining two sheets, the sheets each having identical color patterns thereon, so that the positions of the same color patterns on each of the sheets coincide with each other comprising: p1 a joining means for joining the two sheets;

first and second feeding means each for feeding one of the sheets into the joining means;

first and second photo-sensing means each for optically sensing a color pattern on one of the sheets during feeding and for substantially simultaneously generating intensity data for a plurality of different colors for a plurality of points on the sheet;

first and second subtracting means each for calculating differences between the intensity data for different colors generated by the respective photo-sensing means;

a mismatch-detecting means for calculating a mismatch distance for the patterns on the two sheets based on the calculated differences; and a feed adjusting means for adjusting at least one of the feeding means to match the patterns, based on the calculated mismatch distance.

30. A sheet-joining machine, as in claim 29, where each of the first and second photo-sensing means senses the pattern while the sheets are fed for a preset length, and the mismatch-detecting means calculates the mismatch distance after every feeding of the preset length.

31. A sheet-joining machine, as in claim 29, where each of the first and second photo-sensing means generates red, blue, and green color intensity data, and each of the first and second subtracting means calculates the differences between the red and blue, between the blue and green, and between the green and red color intensity data.

32. A sheet-joining machine, as in claim 31, where the machine further comprises:

first through sixth averaging means each for averaging one of the three difference data generated by one of the subtracting means, the averaging for each point being performed by first adding values of data for several points before and after the point to the value of data for that point, and then dividing the sum by the number of the points added together;

first through sixth featuring means each for calculating a featuring difference which is a difference between the difference generated by the respective subtracting means and the averaged difference calculated by the respective averaging means; and first and second totaling means each for totaling the three featuring differences corresponding to one of the sheets, by which the mismatch-detecting means calculates the mismatch distance.

33. A machine for joining two sheets, the sheets each having identical color patterns thereon, so that the positions of the same color patterns on each of the sheets coincide with each other comprising:

a joining means for joining the two sheets;

first and second feeding means each for feeding one of the sheets into the joining means;

first and second photo-sensing means each for optically sensing a color pattern on one of the sheets during feeding and for substantially simultaneously generating intensity data for a plurality of different colors for a plurality of points on the sheet;

first and second color selection means each for selecting the color intensity data that has the largest change in the intensity;

a mismatch-detecting means for calculating a mismatch distance for the patterns on the two sheets based on the selected color intensity data; and a feed-adjusting means for calculating a mismatch distance for the patterns on the two sheets based on the selected color intensity data; and a feed adjusting means for adjusting at least one of the feeding means to match the patterns, based on the calculated mismatch distance.

34. A sheet-joining machine, as in claim 33, where:

each of the first and second photo-sensing means senses the pattern while the sheets are fed for a preset length;

each of the first and second color selection means selects one of the color intensity data every said preset length; and the mismatch-detecting means calculates the mismatch distance after every said preset length.

35. A sheet-joining machine, as in claim 33, where each of the first and second photo-sensing means generates red, blue, and green color intensity data.

36. A sheet-joining machine, as in claim 35, where each of the first and second color selection means comprises:

first through third averaging means each for averaging one of the three color intensity data generated by the respective photo-sensing means, the averaging for each point being performed by first adding values of data for several points before and after the point to the value of data for that point, and then dividing the sum by the number of the points added together;

first through third differentiating means each for calculating a differential for each of the respective averaged color intensity data; and a color selecting means for selecting the differentiated color intensity data that has the largest peak-to-peak height.

37. A machine for matching two sheets, the sheets each having identical color patterns thereon, so that the positions of the same color patterns on each of the sheets coincide with each other comprising:

first and second photo-sensing means each for optically sensing a color pattern on one of the sheets, and for generating intensity data for a plurality of different colors;

a mismatch-detecting means for calculating a mismatch distance of the patterns on the two sheets based on the intensity data for the plurality of different colors; and a sheet moving means for moving the sheets according to the calculated mismatch distance to match the patterns of the two sheets.

38. A sheet matching machine, as in claim 37, further comprising a processing means for processing the two sheets.

39. A sheet matching machine, as in claim 37, where the mismatch-detecting means comprises first and second subtracting means each for calculating differences between the intensity data for different colors generated by the respective photo-sensing means.

40. A sheet matching machine, as in claim 37, where the mismatch-detecting means further comprises first and second color selection means each for selecting the color intensity data that has the largest change in the intensity.

41. A sheet matching machine, as in claim 37, where the first and second photo-sensing means substantially simultaneously generate intensity data for a plurality of different colors.

* * * * *